US006733368B1

(12) United States Patent
Pan et al.

(10) Patent No.: US 6,733,368 B1
(45) Date of Patent: May 11, 2004

(54) METHOD FOR LAPPING A WAFER

(75) Inventors: Yi Pan, Vancouver, WA (US); Brazel G. Preece, Vancouver, WA (US)

(73) Assignee: SEH America, Inc., Vancouver, WA (US)

( * ) Notice: Subject to any disclaimer, the term of this patent is extended or adjusted under 35 U.S.C. 154(b) by 0 days.

(21) Appl. No.: 10/361,717

(22) Filed: Feb. 10, 2003

(51) Int. Cl.[7] ..... B24B 1/00

(52) U.S. Cl. ..... 451/36; 451/41; 451/60; 451/177; 451/259; 451/262; 451/268; 451/447

(58) Field of Search ..... 451/36, 41, 60, 451/177, 259, 262, 268, 447

(56) References Cited

U.S. PATENT DOCUMENTS 4,059,929 A * 11/1977 Bishop ..... 451/60
4,679,359 A 7/1987 Suzuki
5,718,618 A 2/1998 Guckel et al.
5,993,298 A 11/1999 Duescher
6,102,778 A 8/2000 Morita
6,149,506 A 11/2000 Duescher

* cited by examiner

*Primary Examiner*—Lee D. Wilson
*Assistant Examiner*—Shantese McDonald
(74) *Attorney, Agent, or Firm*—Alston & Bird LLP

(57) ABSTRACT

An improved method for lapping the opposed major surfaces of a wafer is provided. In this regard, a multi-step lapping process is provided in which lapping continues while transitioning from a first slurry having larger abrasive particles to a second slurry having smaller abrasive particles so as to reduce the overall length of the lapping process. In addition, the multi-step lapping process is optimized so as to remove no more than about 90 microns in total thickness from the opposed major surfaces of the wafer. By completing the lapping with slurry having smaller abrasive particles, subsequent etching of the wafers produces shallower surface pitting. As such, the wafers generally require less polishing than required by conventional processes.

21 Claims, 2 Drawing Sheets

METHOD FOR LAPPING A WAFER

FIELD OF THE INVENTION

The present invention relates to the manufacture of wafers, such as silicon wafers, and, more particularly, to an improved method for lapping the opposed major surfaces of a wafer.

BACKGROUND OF THE INVENTION

Wafers, such as silicon wafers, form the substrate upon which a variety of semiconductor devices are fabricated. In order to ensure that the semiconductor devices perform properly, wafers must generally be fabricated to exacting specifications. Additionally, wafers must be manufactured in an efficient and economic manner, since the sale of wafers to the various device manufacturers is quite cost competitive.

The manufacture of wafers involves a number of sequential steps to produce a wafer that meets the exacting specifications of the various device manufacturers. Initially, a crystal ingot is grown, such as by the Czochralski method. The crystal ingot is sliced into a plurality of wafers. The edge of each wafer is then generally ground to properly size the wafer and to impart the desired profile, such as a rounded or chamfered profile, to the edge of the wafer. The opposed major surfaces of the wafer are then lapped in order to planarize the wafer by reducing thickness variations and improving flatness across each major surface. According to one lapping technique, the opposed major surfaces of each wafer are lapped with a 1200 grit slurry so as to reduce the total thickness of the wafer by about 70 microns.

The opposed major surfaces are then typically etched so as to reduce the number of surface defects. Conventionally, the opposed major surfaces are subjected to a wet chemical etch using an alkali etchant, an acidic etchant or a combination of both alkali and acidic etchants. However, the opposed major surfaces may be dry etched if desired, as described in U.S. patent application Ser. No. 10/361,280, filed concurrently herewith and entitled METHOD FOR FABRICATING A WAFER INCLUDING DRY ETCHING THE EDGE OF THE WAFER, tie contents of which are incorporated herein by reference. Typically, the etching process removes about 20 microns in total from the opposed major surfaces. The edge of the wafer is then etched and/or polished. In this regard, the edge may be subjected to a wet chemical etch followed by polishing. Alternatively, the edge of the wafer may be dry etched as also described by above-referenced patent application, along with an optional polishing operation.

Thereafter, at least one of the major surfaces is polished to have the desired mirrored finish. For those applications in which only a single side of the wafer is polished, the polishing operation may remove about 12 microns in thickness from the front side of the wafer. Alternatively, in those applications in which both of the opposed major surfaces are polished, the polishing operation may remove about 22 microns in total from the front and rear surfaces of the wafer. While the polishing operation removes less material than the lapping and etching processes, the polishing operation generally takes substantially longer to remove the same amount of material and is therefore a substantial factor in the overall cost and efficiency with which the wafers are fabricated.

Each step of the wafer fabrication process has many variations depending upon the application. With respect to lapping of the wafer, for example, lapping techniques have been developed that successively lap the opposed major surfaces of the wafer with different slurries. By way of example, one lapping technique initially removes about 70 microns in total thickness from the opposed major surfaces with a 1200 grit slurry. Instead of proceeding to the etching operation as described above, the opposed major surfaces of the wafer may then be subjected to further lapping with a 1500 grit slurry in order to remove another 30 microns in total thickness from the wafer. By lapping with the 1500 grit slurry, the quality of the wafer surface is improved so that the wafer surface exhibits shallower surface pitting, thereby resulting in more efficient etching and polishing of the major surfaces. Unfortunately, this multi-step lapping operation removes more material than conventional lapping processes and accordingly substantially increases the time expended during the lapping operation.

As described above, it would be desirable to improve the overall efficiency of the wafer fabrication process while maintaining or improving the quality of the wafers fabricated thereby. In this regard, it would be desirable to improve the wafer fabrication process such that the overall process for fabricating a single wafer is at least somewhat less expensive. In this regard, even a modest decrease in the cost to fabricate a single wafer can represent a large savings to a wafer manufacturer in view of the multitudes of wafers fabricated each year.

BRIEF SUMMARY OF THE INVENTION

An improved method for lapping the opposed major surfaces of a wafer is provided in accordance with the present invention. The improved lapping method increases the efficiency of the overall wafer fabrication process, while maintaining or improving the quality of the wafers produced thereby. In this regard, embodiments of the present invention provide a multi-step lapping process in which lapping continues while transitioning from a first slurry to a second slurry so as to reduce the overall length of the lapping process. In addition, the multi-step lapping process of the present invention is optimized so as to remove no more than about 90 microns in total thickness from the opposed major surfaces of the wafer so as to similarly reduce the time required for the overall lapping process. By completing the lapping with slurry having smaller abrasive particles, wafers are produced that have improved quality, such as by having shallower surface pitting, relative to wafers fabricated in accordance with conventional fabrication techniques that utilize a single lapping step with 1200 grit slurry.

According to the present invention, the first and second opposed major surfaces of a wafer are initially lapped with a first slurry. After reducing the thickness of the wafer by a desired amount with the first slurry, a second slurry is introduced and the lapping of the major surfaces continues with the second slurry. In this regard, the lapping continues while introducing the second slurry such that the major surfaces are exposed to a combination of both the first and second slurries for a period of time. Thereafter, the major surfaces of the wafer are predominantly exposed to and lapped by the second slurry.

Both the first and second slurries include abrasive particles, with the abrasive particles of the second slurry being smaller on an average than the abrasive particles of the first slurry. For example, the first slurry may be no more than 1200 grit so as to have abrasive particles with an average size of at least 8 microns. In this regard, the first slurry may be 1200 grit, 1000 grit, or less. Conversely, the second slurry is advantageously at least 1500 grit so as to have abrasive particles with an average size of no more than about 6 microns. As a result of the relative sizes of the abrasive particles of the first and second slurries, lapping of the wafer with the first slurry proceeds more quickly, i.e., with a greater removal rate, than lapping of the wafer with the second slurry. Additionally, by continuing to lap the wafer while introducing the second slurry, the removal rate gradually transitions from the faster removal rate associated with lapping of the wafer with the first slurry to the slower removal rate associated with lapping of the wafer with the second slurry.

According to the present invention, the lapping of the major surfaces of the wafer with the first and second slurries collectively removes no more than about 90 microns in total thickness and, in one advantageous embodiment, removes no more than about 80 microns in total thickness and, in one particularly advantageous embodiment, no more than about 70 microns in total thickness. Of this, lapping of the major surfaces of the wafer with the first slurry advantageously removes more material than that removed by continuing to lap the major surfaces of the wafer with the second slurry. In this regard, the lapping of the major surfaces of the wafer once the second slurry has been introduced may remove no more than about 25 microns in total thickness and, in one advantageous embodiment, no more than about 20 microns in total thickness.

By completing the lapping process with a slurry having smaller abrasive particles, the quality of the wafer at the commencement of the etching process is improved, such as by having shallower surface pitting. Thus, the etching and polishing operations may proceed more efficiently, thereby decreasing the time required for the etching and polishing operations and reducing, in some embodiments, the total thickness of the wafer that must be removed during the polishing operation. Moreover, by reducing the total thickness of the wafer that is removed by the lapping process of the present invention relative to conventional multi-step lapping processes and by reducing the quantity of material that must be removed by lapping with the slurry having the smaller abrasive particles, the time required for the overall lapping process of the present invention is correspondingly reduced, which also serves to improve the efficiency of the overall wafer fabrication process.

BRIEF DESCRIPTION OF THE DRAWINGS

Figure 1:
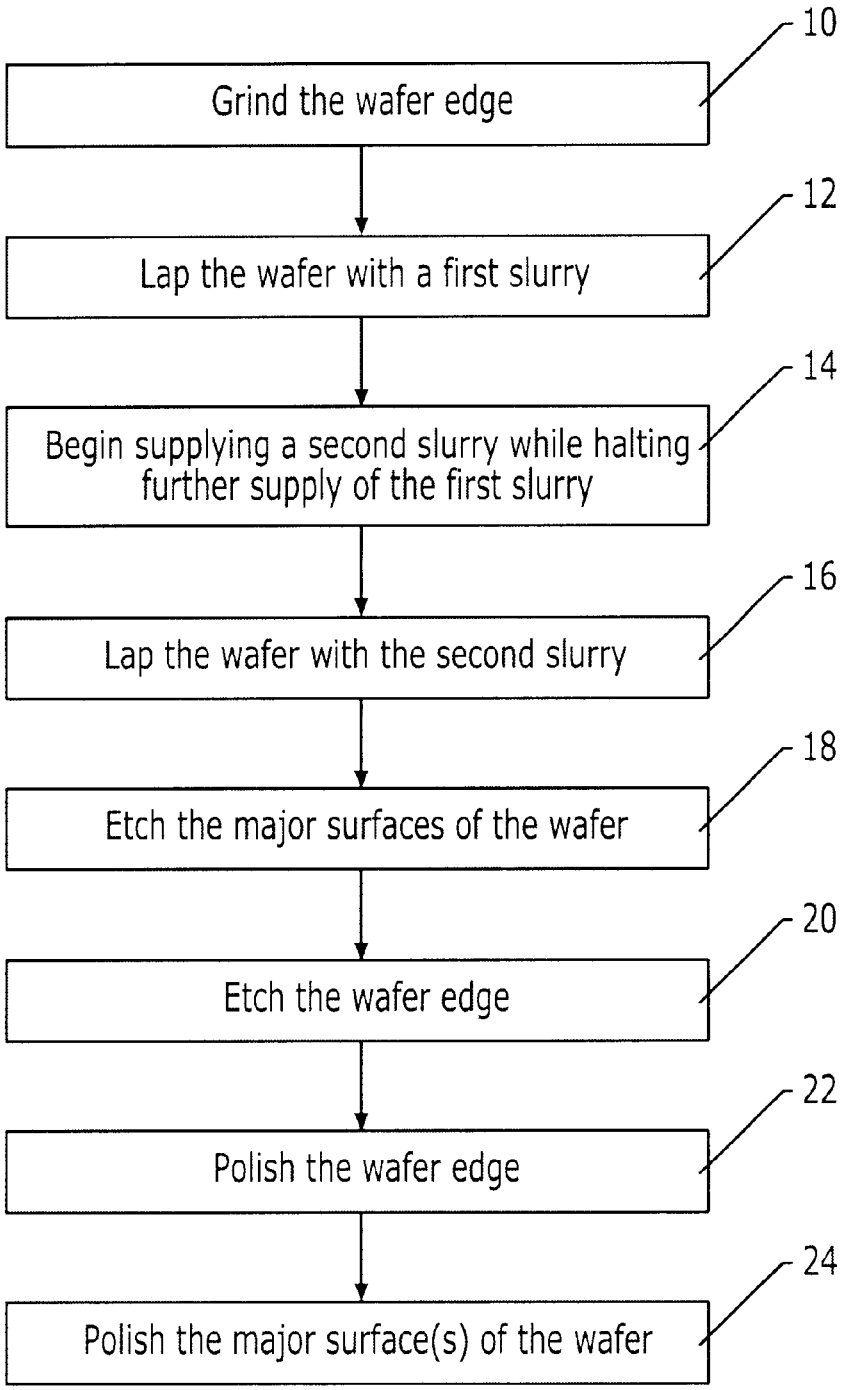
Figure 2:
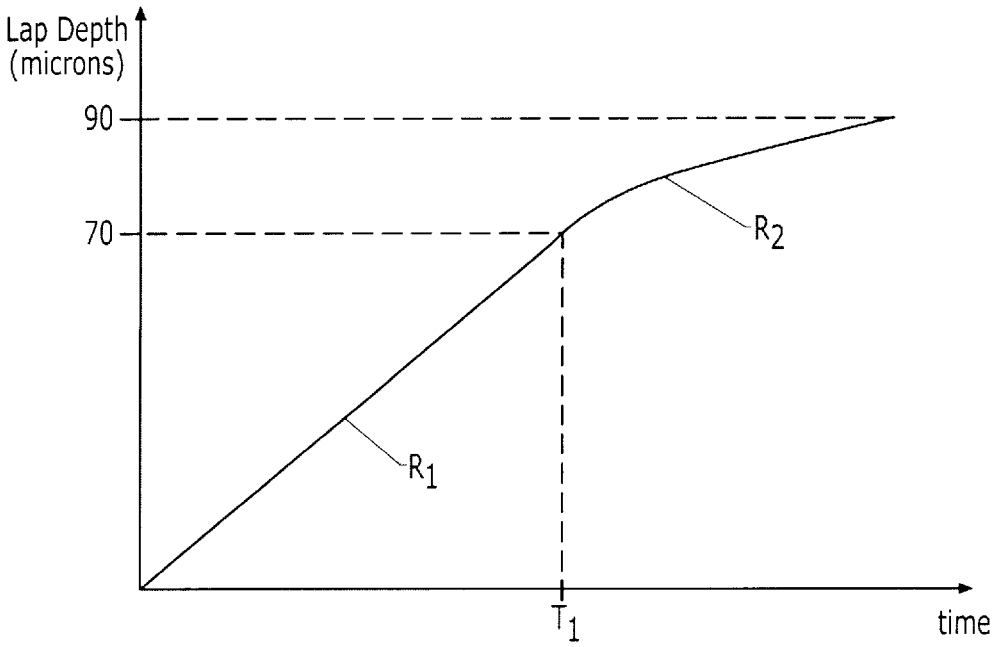
Figure 3:
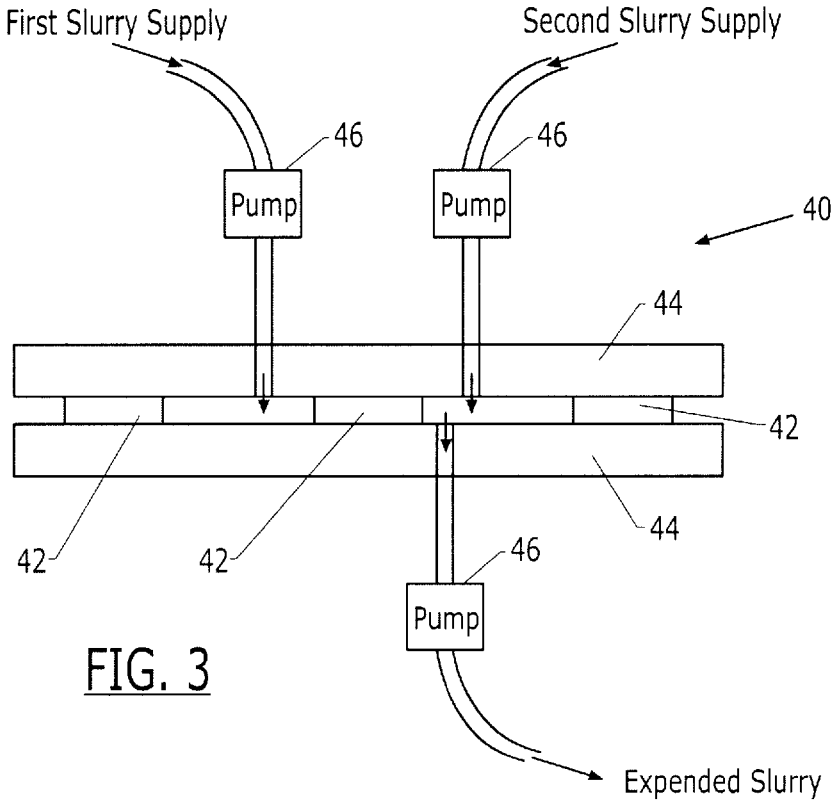

Having thus described the invention in general terms, reference will now be made to the accompanying drawings, which are not necessarily drawn to scale, and wherein:

FIG. 1 is a flow chart of an overall wafer fabrication process in accordance with one embodiment of the present invention;

FIG. 2 is a graph representing the relative removal rates provided by lapping with the first and second slurries in accordance with one embodiment of the present invention; and FIG. 3 is a schematic representation of an apparatus for lapping a plurality of wafers that may be operated in accordance with the lapping method of one embodiment of the present invention.

DETAILED DESCRIPTION OF THE INVENTION

The present inventions now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

As depicted in FIG. 1, the process for fabricating a wafer consists of a series of steps that culminate in the manufacture of a plurality of wafers, each of which generally meets exacting specifications. Prior to commencing the wafer fabrication operations depicted in FIG. 1, a plurality of wafers are generally formed by growing a crystal ingot and then slicing the crystal ingot into a plurality of wafers as known to those skilled in the art. As depicted in block 10 of FIG. 1, the edge of each wafer is typically ground to appropriately size the wafer and to impart the desired profile to the edge of the wafer. As known to those skilled in the art, the edge of most wafers is either chamfered or rounded.

After grinding the edge of the wafer, the first and second opposed major surfaces of the wafer are lapped. As indicated generally in blocks 12 and 16 of FIG. 1, the wafer is initially lapped with the first slurry and is thereafter lapped with a second slurry. Each slurry has abrasive particles with the abrasive particles of the first slurry being larger on average than those of the second slurry such that lapping of the wafer with the first slurry proceeds at a rate, i.e., a removal rate, greater than that effected by lapping with the second slurry. In this regard, the first slurry is preferably no more than 1200 grit so as to have abrasive particles with an average size of at least 8 microns. In this regard, the first slurry may be 1200 grit with abrasive particles having an average size of about 8 microns. Alternatively, the first slurry may be 1000 grit so as to have abrasive particles with an average size of about 10 microns, or the first slurry could have an even smaller grit with even larger abrasive particles. Various types of slurry may be utilized with one typical slurry primarily including oxide particles, such as particles of aluminum oxide and zirconium oxide. While suitable slurry can be obtained from a number of vendors, one vendor is Fijimi Corporation of Elmhurst, Ill., that provides 1200 grit slurry under the trade name FO1200, 1000 grit slurry under the trade name FO1000, and so on.

After reducing the thickness of the wafer by a desired amount as described below, the second slurry is introduced, and the supply of the first slurry is halted while continuing to lap the opposed major surfaces of the wafer. See block 14 of FIG. 1. The second slurry also includes abrasive particles, albeit smaller abrasive particles, than those of the first slurry. In this regard, the second slurry is preferably at least 1500 grit so as to have abrasive particles with an average size of no greater than 6 microns. For example, the second slurry may be 5000 grit with abrasive particles having an average size of 6 microns. As with the first slurry, the second slurry may have various formulations and, in one embodiment, includes abrasive particles formed of oxides, such as aluminum oxide, zirconium oxide and the like. Also similar to the first slurry, the second slurry can be obtained from various vendors, including Fijimi Corporation, which markets 1500 grit slurry under the trade name FO1500.

The lapping process is advantageously continuous from the initial lapping of the wafer with the first slurry (block 12), through the introduction of the second slurry and the corresponding termination of any further supply of the first slurry (block 14), and thereafter with the continued lapping of the wafer with the second slurry (block 16). As such, during the transition from the first slurry to the second slurry, the wafer will be lapped with a combination of both the first and second slurries. As additional second slurry is supplied, this combination of the first and second slurries takes on a greater percentage of the second slurry until the wafer is being lapped predominantly, if not entirely, with the second slurry.

In one embodiment in which all other variables associated with the lapping process remain the same, the decrease in the average size of the abrasive particles from the first slurry to the second slurry will cause a corresponding reduction in the rate of removal from the opposed major surfaces of the wafer. As shown in FIG. 2, for example, lapping of the opposed major surfaces with the first slurry proceeds at a first removal rate $R_1$, such as 5 microns per minute for a 1200 grit slurry. Once the supply of the first slurry is halted, however, and the second slurry having smaller abrasive particles is introduced beginning at time $T_1$ in FIG. 2, the removal rate slows as the opposed major surfaces of the wafer are now abraded by a combination of the remaining first slurry and the newly added second slurry. Over time, such as typically over a period of about 2 minutes, the majority, if not all, of the first slurry is removed such that the opposed major surfaces of the wafers will thereafter predominantly, if not exclusively, be lapped with the second slurry, resulting in a second removal rate $R_2$ that is slower than the first removal rate. For example, the removal rate for 1500 grit slurry is typically about 3 microns per minute. As shown in FIG. 2, the transition from lapping exclusively with the first slurry to lapping predominantly, if not exclusively, with the second slurry occasions a similar transition from the first, more rapid removal rate to a second slower removal rate.

As a result of the more rapid rate of removal provided by lapping with the first slurry, the lapping process is advantageously designed such that a larger percentage of the lapping is performed with the first slurry and, therefore, at the first removal rate. In addition, the overall lapping process is designed to reduce the thickness of the wafer by no more than is necessary to sufficiently planarize the wafer, thereby similarly improving the efficiency of the overall wafer fabrication process. In this regard, the method of lapping the wafer in accordance with the present invention reduces the thickness of the wafer by no more than about 90 microns and, in one advantageous embodiment, by no more than about 80 microns and, in one particularly advantageous embodiment, by no more than 70 microns. Thus, the method of lapping in accordance with the present invention takes significantly less time than other lapping processes that remove 100 microns or more in total wafer thickness. However, by removing 90 microns, 80 microns, 70 microns or the like, the lapping method of the present invention effectively planarizes the wafer so as to have the desired flatness and minimal thickness variations.

As described below, the typical lapping apparatus operates in batch mode and laps a plurality of wafers simultaneously. Moreover, to ensure that each of the wafers is sufficiently planarized, the lapping process generally requires at least 60 microns or 70 microns of total thickness be removed to accommodate for wafer-to-wafer variations. However, in instances in which a single wafer or a small number of wafers having relatively minimal wafer-to-wafer variations are lapped, the lapping method of the present invention may advantageously reduce the thickness of the wafer(s) by even smaller amounts.

Of the total thickness of 90 microns or less that is removed in accordance with the present invention, a majority of this amount is advantageously removed by lapping with the first slurry in order to increase the efficiency of the overall process since lapping with the first slurry removes material at a quicker rate than does lapping with the second slurry having smaller abrasive particles. Although lapping effectively planarizes a wafer, the lapping process generally creates some surface damage or cracks in the wafer. Typically, the size or depth of the surface damage is approximately equal to the size of the abrasive particles in the slurry. As known to those skilled in the art, the cracks or other surface damage which remain following the lapping process generally creates pits in the wafer surface following the etching process. These pits, or at least a majority of these pits, must then be removed by polishing the wafer. As such, it would be advantageous to reduce the amount of cracks or other surface damage occasioned by the lapping process in order to generate fewer and/or smaller pits during the etching process, thereby requiring less polishing.

In order to create smaller cracks and/or less surface damage in the surface of the wafer, the lapping process is advantageously completed utilizing a slurry having relatively small abrasive particles. In the example provided above in which the wafer is initially lapped with 1200 grit slurry having abrasive particles that are about 8 microns in size and is thereafter lapped with a second slurry having abrasive particles that are about 6 microns in size, the majority of the lapping is performed utilizing the 1200 grit slurry. However, the 1200 grit slurry will create cracks and other surface damage within a region having a depth of about 8 microns proximate each of the opposed major surfaces. As such, the final portion of the overall lapping operation is performed with slurry having smaller abrasive particles, i.e., the 1500 grit slurry.

At a minimum, the second slurry having smaller abrasive particles is advantageously utilized to reduce the total thickness of the wafer by twice the difference between the average particle size of the first and second slurries or about 4 microns when the first and second slurries have abrasive particles that are about 8 and 6 microns, respectively. In this regard, the second slurry causes cracks and other surface damage in a region proximate each opposed major surface that has a depth equal to about the average particle size of the second slurry. By removing material equal in thickness to the difference between the average particle sizes of the first and second slurries from each of the opposed major surfaces, the surface damage can be reduced to cracks and other surface damage within a region proximate the opposed major surfaces that has a depth equal to the average particle size of the second slurry, i.e., within about a 6 micron region proximate the opposed major surfaces for 1500 grit slurry.

Out of caution, however, the wafer is advantageously lapped with the second slurry so as to remove a greater thickness so as to ensure that the region having cracks and other surface damage following the lapping with the second slurry will only have cracks and surface damage to a depth about equal to the average particle size of the second slurry, and not the average particle size of the first slurry. Typically, the wafer is lapped with the second slurry so as to remove at least as much material as that damaged by the lapping with the first slurry or, in other words, to remove material having a thickness at least equal to the average particle size of the abrasive particles of the first slurry, such as about 8 microns from each of the opposed major surfaces in one examplary embodiment. More typically, the wafer is lapped with the second slurry so as to remove slightly more material in total thickness than that damaged during the lapping with the first slurry. In embodiments in which the first slurry is 1200 grit having abrasive particles with an average size of about 8 microns, the wafer may be lapped with the second slurry so as to remove about 20 microns to about 25 microns in total thickness.

Thus, one embodiment in which 90 microns in total thickness is removed during the entire lapping process, the initial 70 microns may be removed with 1200 grit slurry, and the final 20 microns may be removed by 1500 grit slurry, thereby producing a wafer having less surface damage than those conventional wafers lapped entirely with 1200 grit slurry. As described below, the reduced surface damage results in shallower surface pitting following the etching process and, in turn, requires less polishing.

The wafers may be lapped with a variety of lapping apparatus. For example, conventional lapping apparatus include Model Nos. 32B, 22B and 20B provided by Fujikoshi Machinery Company (FMC). As known to those skilled in the art, a conventional lapping apparatus laps a plurality of wafers simultaneously. As shown schematically in FIG. 3, a conventional lapping apparatus 40 sandwiches the plurality of wafers 42 between a pair of heavy plates 44 that are urged together such that significant force is imparted to the wafers. A conventional lapping apparatus also includes several pumps 46 and associated plumbing for providing slurry to the region between the plates in which the wafers are disposed and for drawing expended slurry away from the same region. In addition, a conventional lapping device includes a motor and other drive elements (not shown) for rotating one or more of the plates between which the wafers are sandwiched in a manner that causes somewhat eccentric movement of the wafers therebetween.

During lapping, fresh slurry is generally continuously provided, while expended slurry is generally continuously extracted. According to the present invention, a supply of the first slurry, such as a 1200 grit slurry, is provided, and the expended first slurry is extracted for a period of time sufficient to remove about 70 microns in total thickness. Thereafter, the supply of the first slurry is terminated, and the second slurry, such as a 1500 grit slurry, is then simultaneously supplied. For a period of time, a combination of both the first and second slurries will be present between the plates and contribute to lapping the wafers. However, by continuing to extract the expended slurry from between the plates while also continuing to provide the second slurry, the slurry that is between the plates and contributes to the lapping of the wafers will transition to a slurry that is predominantly, if not exclusively, the second slurry. While this transition may occur over different periods of time, this transition may take two minutes or so in a common examplary application. Moreover, in the example provided above in which about 90 microns in total thickness is removed from the wafer, the second slurry is advantageously supplied for a period of time sufficient to remove about 20 microns in total thickness.

As shown in FIG. 2, the initial removal rate $R_1$ with the first slurry is relatively rapid, and the final removal rate $R_2$ with the second slurry is relatively slow due to the different sizes of the abrasive particles of the first and second slurries. However, during the transition period during which the second slurry is initially supplied, the removal rate transitions from the more rapid removal rate with the first slurry to the slower removal rate with the second slurry over a period of time in which the second slurry is continuously supplied and the expended slurry (including decreasing amounts of the first slurry) is extracted from the region between the plates in which the wafers are disposed.

Once the lapping process is completed, the wafers may be removed from the lapping apparatus, and rinsed or otherwise cleaned. By completing the lapping process with slurry having smaller abrasive particles, the overall lapping process generally takes longer than if the entire lapping process was performed with the first slurry. In instances in which about 90 microns of total thickness are removed from the wafer with the first slurry removing the initial 70 microns in total thickness, and the second slurry removing about the final 20 microns of total thickness, the two-step lapping process will take about one minute longer than if the entire lapping process had been performed utilizing the first slurry. As such, while the improved lapping process of the present invention will save both time and money as described below, the advantages of the lapping process are somewhat counterintuitive, since the lapping process itself may take longer and therefore may be more costly than conventional lapping processes. Instead, the advantages provided by the lapping process are primarily borne out during subsequent processing steps, such as etching and polishing.

Once the wafers have been rinsed and/or cleaned, the wafers are etched as shown in block 18 of FIG. 1. Typically, the etch is a wet etch. However, the wafers may be dry etched as described by concurrently filed U.S. patent application Ser. No. 10/361,280 entitled METHOD FOR FABRICATING A WAFER INCLUDING DRY ETCHING THE EDGE OF THE WAFER. Regardless of the type, the etching also reduces the thickness of the wafer, such as by about 20 microns, in order to reduce surface defects and remove contaminants. In the etching process, however, the cracks and other surface damage created by the lapping process may create etch pits in the wafer surface. The depth and size of the etch pits are generally dependent upon the depth and size of the surface damage created by the lapping process. As such, by completing the lapping process with slurry having smaller abrasive particles and thereby creating a shallower region of surface damage, the resulting etch pits are smaller than those produced by conventional wafer fabrication processes that lap only with the first slurry, for example. Moreover, since the surface of the wafer has less damage and is generally smoother as a result of the final lapping with the second slurry, less surface removal is required at etching. By being capable of being performed more rapidly, less etchant is required, thereby lengthening the lifetime of the etch bath and lowering the overall cost of manufacture of the wafers.

Following the etching process, the edge of the wafer may be etched and/or polished. See blocks 20 and 22 of FIG. 1. While the edge of the wafer is typically wet etched and then polished so as to have a mirror-like finish, the edge of the wafer may be dry etched and then optionally polished, as described by the above-referenced patent application. Thereafter, at least one and, in some embodiments, both major surfaces of the wafer are polished so as to also have a mirror-like finish, as shown in block 24 of FIG. 1. The depth of the polishing is typically chosen to be sufficient so as to remove or etch below the etch pits created during the etching process. In a conventional wafer manufacturing process in which only a single-side of the wafer is polished, about 6–12 microns in thickness is removed by the polishing operation. Alternatively, in conventional fabrication processes in which both sides of the wafer are polished, about 18–26 microns in total thickness are removed by the polishing process. As a result of the shallower etch pits due, in turn, to the reduced surface damage created by the improved lapping method of the present invention, less material must be removed by the polishing process, such as about 4–10 microns in instances in which only a single side of the wafer is polished and about 14–22 microns in instances in which both major surfaces of the wafer are polished. As will be apparent, the reduction in the depth to which the wafer must be polished while still maintaining or improving the quality of the wafer reduces the overall time expended during fabrication and reduces the consumption of slurry utilized during the polishing process.

While the savings attributable to the improved lapping method of the present invention will vary depending upon the specific implementation, it has been found that the improved lapping process may save between about six to ten cents per wafer. Given the extremely large number of wafers typically manufactured, this savings provided by the improved lapping method can be quite significant.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A method for lapping first and second opposed major surfaces of a wafer comprising:

initially lapping the major surfaces with a first slurry;

introducing a second slurry having abrasive particles that are smaller on average than those of the first slurry; and continuing to lap the major surfaces with the second slurry, wherein introducing the second slurry occurs while continuing to lap the major surfaces such that the major surfaces are exposed to both the first and second slurries for at least a period of time, wherein lapping the major surfaces with the first slurry removes more material than that removed by continuing to lap the major surfaces with the second slurry, and wherein lapping the major surfaces with the first and second slurries collectively removes no more than about 90 microns in thickness.

2. A method according to claim 1 wherein continuing to lap the major surfaces while the second slurry is introduced removes no more than 25 microns in thickness.

3. A method according to claim 1 wherein lapping the major surfacing with the first and second slurries collectively removes no more than about 80 microns in thickness.

4. A method according to claim 3 wherein lapping the major surfaces with the first and second slurries collectively removes no more than about 70 microns in thickness.

5. A method according to claim 4 wherein continuing to lap the major surfaces while the second slurry is introduced removes no more than about 20 microns in thickness.

6. A method according to claim 1 wherein initially lapping the major surfaces with the first slurry comprises lapping the major surfaces with a first slurry that is no more than 1200 grit so as to have abrasive particles with an average size of at least about 8 microns.

7. A method according to claim 6 wherein lapping the major surfaces with a first slurry that is no more than 1200 grit comprises lapping the major surfaces with a first slurry that is not more than 1000 grit.

8. A method according to claim 1 wherein continuing to lap the major surfaces with the second slurry comprises continuing to lap the major surfaces with a second slurry that is at least 1500 grit so as to have abrasive particles with an average size of no more than about 6 microns.

9. A method for lapping first and second opposed major surfaces of a wafer comprising:

initially lapping the major surfaces with a first slurry so as to remove material from the major surfaces at a first removal rate;

introducing a second slurry; and continuing to lap the major surfaces while introducing the second slurry, wherein continuing to lap the major surfaces comprises lapping the major surfaces with a combination of both the first and second slurries upon the initial introduction of the second slurry and thereafter lapping the major surfaces predominantly with the second slurry, and wherein lapping the major surfaces predominantly with the second slurry removes material from the major surfaces at a second removal rate less than the first removal rate and lapping the major surfaces with a combination of both the first and second slurries removes material from the major surfaces at a removal rate that transitions between the first and second removal rates, and wherein lapping the major surfaces with the first and second slurries collectively removes no more than about 90 microns in thickness.

10. A method according to claim 9 wherein continuing to lap the major surfaces while the second slurry is introduced removes no more than 25 microns in thickness.

11. A method according to claim 9 wherein lapping the major surfaces with the first and second slurries collectively removes no more than about 80 microns in thickness.

12. A method according to claim 11 wherein lapping the major surfaces with the first and second slurries collectively removes no more than about 70 microns in thickness.

13. A method according to claim 12 wherein continuing to lap the major surfaces while the second slurry is introduced removes no more than about 20 microns in thickness.

14. A method according to claim 9 wherein initially lapping the major surfaces with the first slurry comprises lapping the major surfaces with a first slurry that is no more than 1200 grit so as to have abrasive particles with an average size of at least about 8 microns.

15. A method according to claim 14 wherein lapping the major surfaces with a first slurry that is no more than 1200 grit comprises lapping the major surfaces with a first slurry that is not more than 1000 grit.

16. A method according to claim 9 wherein continuing to lap the major surfaces with the second slurry comprises continuing to lap the major surfaces with a second slurry that is at least 1500 grit so as to have abrasive particles with an average size of no more than about 6 microns.

17. A method for lapping first and second opposed major surfaces of a wafer comprising:

initially lapping the major surfaces with a first slurry that is no more than 1200 grit so as to have abrasive particles with an average size of at least about 8 microns;

introducing a second slurry that is at least 1500 grit so as to have abrasive particles with an average size of no greater than about 6 microns continuing to lap the major surfaces with the second slurry, wherein introducing the second slurry occurs while continuing to lap the major surfaces such that the major surfaces are exposed to both the first and second slurries for at least a period of time, wherein lapping the major surfaces with the first and second slurries collectively removes no more than about 90 microns in thickness; and wherein continuing to lap the major surfaces once the second slurry is introduced removes no more than about 25 microns in thickness.

18. A method according to claim 17 wherein lapping the major surfaces with the first and second slurries collectively removes no more than about 80 microns in thickness.

19. A method according to claim 18 wherein lapping the major surfaces with the first and second slurries collectively removes no more than about 70 microns in thickness.

20. A method according to claim 19 wherein continuing to lap the major surfaces while the second slurry is introduced removes no more than about 20 microns in thickness.

21. A method according to claim 17 wherein lapping the major surfaces with a first slurry that is no more than 1200 grit comprises lapping the major surfaces with a first slurry that is not more than 1000 grit.

* * * * *